United States Patent [19]

Ryan

[11] 4,045,989

[45] Sept. 6, 1977

[54] SHEET METAL BENDING APPARATUS

[75] Inventor: Marshall John Ryan, Palatine, Ill.

[73] Assignee: The Lockformer Company, Lisle, Ill.

[21] Appl. No.: 747,252

[22] Filed: Dec. 3, 1976

[51] Int. Cl.[2] ..... B21B 39/02; B21D 5/08; B21B 1/24

[52] U.S. Cl. ..... 72/133; 72/177; 72/181; 72/187; 72/227; 72/234

[58] Field of Search ..... 72/133, 134, 166, 176, 72/177, 181, 187, 221, 223, 226–228, 231, 234

[56] References Cited

U.S. PATENT DOCUMENTS

| | | | |
|---|---|---|---|
| 1,955,410 | 4/1934 | Colbie | 72/181 |
| 2,370,702 | 3/1945 | Yoder | 72/177 |
| 2,942,506 | 6/1960 | Merting et al. | 72/234 |
| 3,344,641 | 10/1967 | Pomory | 72/177 |
| 3,595,056 | 7/1971 | Hutton | 72/181 |
| 3,750,446 | 8/1973 | Jones | 72/228 |
| 3,777,531 | 12/1973 | McClain | 72/226 |
| 3,796,081 | 3/1974 | Boardman | 72/226 |

FOREIGN PATENT DOCUMENTS

| | | | |
|---|---|---|---|
| 2,521,620 | 12/1975 | Germany | 72/181 |

*Primary Examiner*—E. M. Combs

*Attorney, Agent, or Firm*—McDougall, Hersch & Scott

[57] ABSTRACT

An apparatus for bending sheet metal wherein a plurality of forming rolls are utilized. The rolls are situated at succeeding stations, and a first bending station includes a roll having forming protrusions in spaced apart relationship on the roll surface. The roll also defines drive elements which are engageable by the sheet so that movement of the sheet against a roll drive element operates to drive the roll and to thus move a forming protrusion into contact with the sheet for bending the sheet. Shift means are associated with this roll for locating the drive elements and protrusions in different positions to thereby control the particular drive element engaged by the sheet whereby the particular forming protrusion which performs the bending function can be preselected.

12 Claims, 8 Drawing Figures

FIG. 1
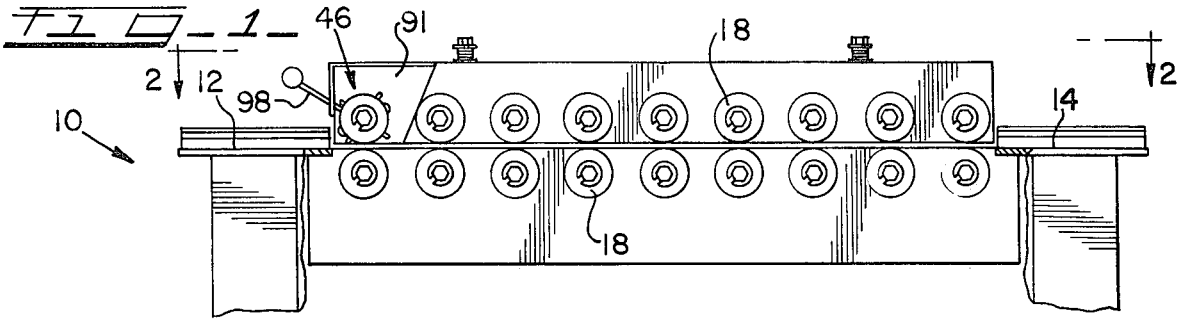
FIG. 2
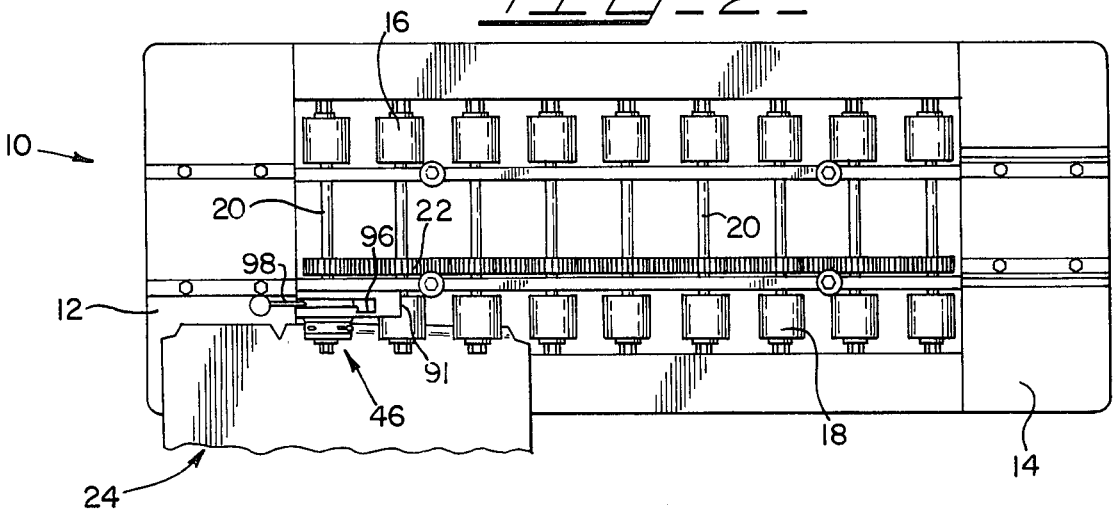
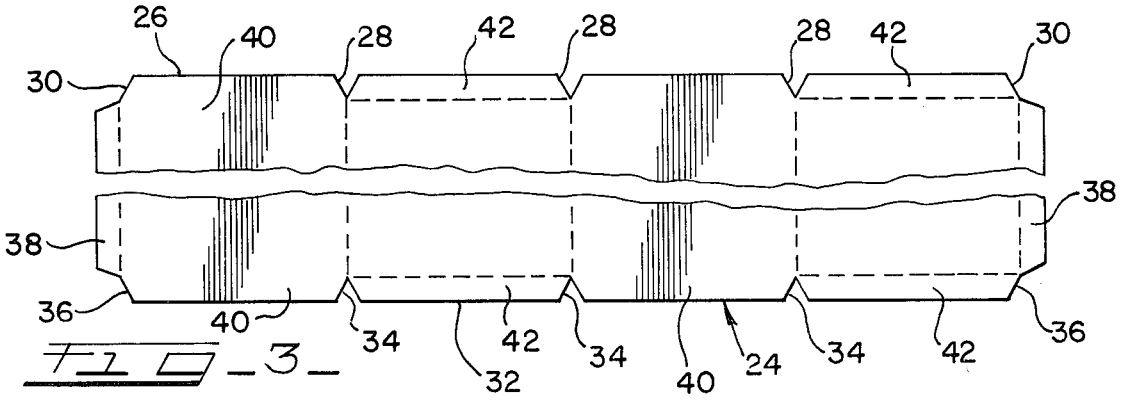
FIG. 3
FIG. 5
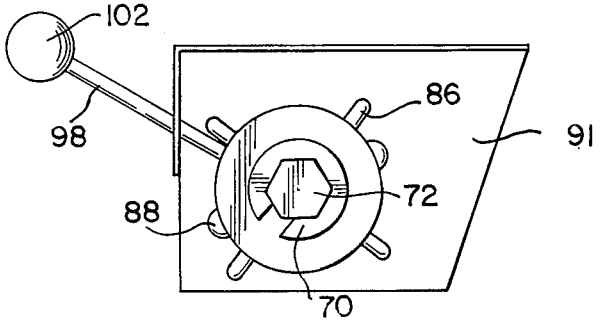
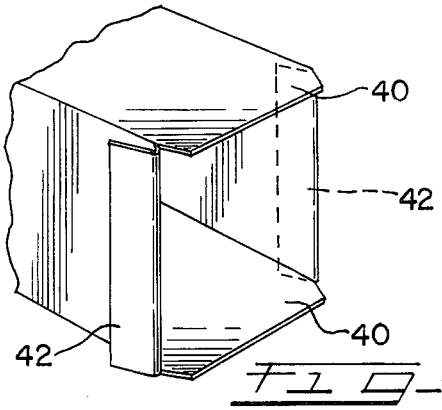
FIG. 4

SHEET METAL BENDING APPARATUS

This invention relates to a sheet metal bending means. The invention is particularly directed to improvements in roll forming machinery.

Roll forming machines have long been utilized for bending sheet metal. Broadly speaking, such machines include successive forming rolls, each located at a forming station. A piece of sheet metal when fed into such a machine will be engaged by a first roll, and a degree of bending then takes place. As the sheet is moved to the next roll, an additional bending function takes place. Successive rolls perform still further bending so that the combined action of all rolls will result in a complete bending operation.

Roll forming machines have been particularly utilized in the fabrication of sheet metal ducts and connectors. Such ducts are of the type typically utilized in heating and air conditioning systems and in ventilating systems.

In such systems, the ducts are produced in sections, and connectors such as drive cleats and re-enforcing connectors are utilized for securing the sections together. In order to facilitate the attachment of such cleats and connectors, the ends of sheets utilized for forming the duct sections are notched so that when the sheet is bent into a rectangular configuration, hem portions for attachment of the cleats and connectors are formed at the ajoining duct ends. In a particular arrangement with which this invention is concerned, such hem portions are alternately bent rearwardly to provide anchors for a drive cleat. The other two hem portions are maintained flat to permit utilization of an "S" cleat connector.

A roll forming machine can be readily utilized for the bending of hems in the manner desired, but since the hem portions of a sheet are adjacent each other along the edge of a sheet, some means must be developed for selectively bending hem portions. In other words, the roll forming machine can only be effectively utilized if it is capable of bending one hem portion, skipping the next hem portion, and then bending the following hem portion. The problem is complicated by the fact that when one end of a sheet for forming a duct section is introduced into a roll forming machine, specific alternating hem portions must be bent. When the other end of the sheet is introduced, however, the bending sequence must be changed in order to provide bent hem portions at the same locations a both ends of the sheet.

One manner of solving the problem referred to involves the use of a roll forming machine which will only bend hem portions which have been partially formed before introduction into the machine. This is accomplished manually, that is, a workman will utilize some tool for bending the ends of alternating hem portions so that only these hem portions are engaged by forming rolls when the sheet is introduced into the machine.

It is a general object of this invention to provide an improved sheet metal bending means.

It is a more specific object of this invention to provide a sheet metal bending means which can be utilized in conjunction with duct forming operations.

It is also a specific object of this invention to provide a sheet metal bending means of the type described which is particularly useful for forming hem portions of sheets to be utilized for forming ducts, the hem portions being alternately formed by the bending means in an automatic fashion without the necessity for any significant manual labor.

It is a still further object of this invention to provide a sheet metal bending means capable of achieving the foregoing objects, the mechanisms employed being of a highly efficient design whereby the mechanisms can be manufactured, used and maintained without difficulty.

These and other objects of this invention will appear hereinafter and for purposes of illustration, but not of limitation, specific embodiments of the invention are shown in the accompanying drawings in which:

FIG. 1 is a side elevation of a sheet metal roll forming machine including bending means characterized by the features of this invention;

FIG. 2 is a plan view of the roll forming machine shown in FIG. 1;

FIG. 3 is a plan view of a sheet metal section of the type formed with the mechanisms of this invention;

FIG. 4 is a fragmentary perspective view illustrating the sheet metal section after forming and after bending into a duct section;

FIG. 5 is a fragmentary side elevational view, partly cut away, illustrating the particular sheet metal bending means which characterize this invention;

Figure 7:
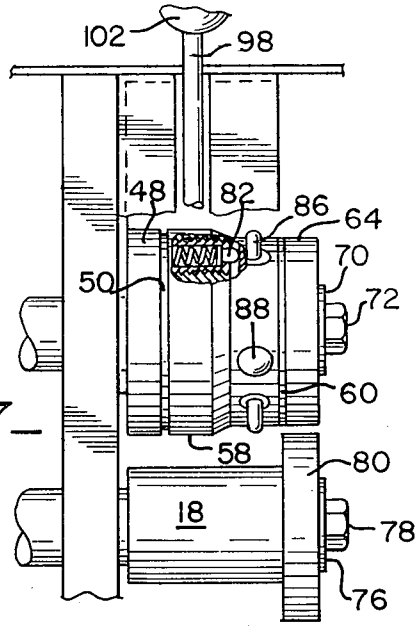
FIG. 7 is a plan view of the structure shown in FIG. 5.

The particular apparatus of this invention comprises a sheet metal bending means. This sheet metal bending means is specifically available for use in a roll forming machine wherein a plurality of forming rolls are utilized for progressively bending the sheet.

The improvement of the invention is particularly directed to a first bending station in a roll forming apparatus. This bending station includes a first forming roll, the roll having forming protrusions extending outwardly from its surface, the protrusions being in spaced apart relationship.

The roll also carries drive elements which are engageable by a sheet introduced into the apparatus. Movement of the sheet relative to the forming roll thus serves to move the roll and an associated forming protrusion into contact with the sheet for bending the sheet. Means are provided for shifting the position of the roll to thereby relocate the drive elements on the roll. Since the forming protrusions are moved in response to engagement of a drive element by the sheet, shifting the position of a drive element will determine the engaging position of a forming protrusion on that forming roll.

The arrangement of the invention described is particularly adapted for use in conjunction with sheet metal duct sections. The notches which are provided for permitting bending of hem portions also serve to provide driving edges for the forming roll. The relative positions of the notches and the forming protrusions on the roll will thus determine when a forming protrusion is brought into contact with the hem portion of a metal duct. By properly locating the drive elements, the forming roll can be made to operate only when it is desired to bring a protrusion into contact with a selected hem portion.

In order to accommodate the different sequence of forming for the opposite hem portions, the structure of this invention is adapted to be shifted into a different operating position. This changes the particular drive element engaged by the respective hem portions of the sheet. Accordingly, the particular sequence of forming of a hem portion can be controlled.

FIGS. 1 and 2 of the accompanying drawings illustrate a roll forming machine 10 which has been modified for the practice of this invention. This machine includes a table section 12 for supporting sheets to be formed and a table section 14 for receiving such sheets after they have passed through the machine. A plurality of forming rolls 16 and 18 are positioned between the respective loading and receiving areas of the machine. These rolls are supported on drive shafts 20, and each shaft also supports a drive gear 22. In accordance with conventional practice, upper and lower forming rolls are provided, and these rolls operate to drive sheets introduced into the machine in addition to performing bending functions.

This invention is concerned with the formation of sheets such as the sheet 24 shown in FIG. 3. This sheet includes a first edge 26 defining intermediate notches 28 and end notches 30. The opposite edge 32 of the sheet defines intermediate notches 34 and end notches 36. The sheet is thus divided into four sections.

The sheet 24 is adapted to be folded into a rectangular duct configuration as shown in FIG. 4. The tab sections 38 formed along the sides of the sheet 24 may be utilized for securing the duct section, for example, by using a conventional snap lock technique.

The areas of the sheet 24 defined between the respective notches comprise hems 40 and 42. As shown in FIG. 4, the hems 42 are bent rearwardly relative to side walls of the duct while the hems 40 remain flat. This configuration is achieved in a duct section to facilitate anchoring of the section to an adjacent section. Thus, the hems which are bent or turned through about 180° are located opposite similarly turned ends of an adjacent duct section, and a conventional drive cleat is utilized in conjunction with the turned hems for anchoring purposes. Similarly, the flat hems overlap, and "S" cleats may be used as connectors for these hems.

It will be appreciated that in order to form the sheet 24, it is necessary to bend the hems 42 while the hems 40 remain flat. It is also necessary to bend the hems 42 along each of the edges 26 and 32 of the sheet 24. Since the forming rolls utilized for such purposes bend in only one direction, it is necessary to introduce one end of the sheet into the forming machine when bending one edge with the other end of the sheet being introduced when bending the other edge. To illustrate, when bending the hems 42 along the edge 26, the right-hand end of the sheet shown in FIG. 3 will be the leading end in which case the first and third hems encountered by the machine will be bent. When forming along the opposite edge 32 of the sheet 24, the left-hand end of the sheet must be introduced as the leading end in which case the second and fourth hems are bent by the machine.

Figure 6:
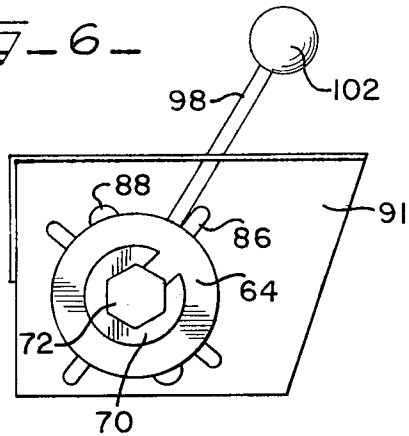
FIG. 6 is a fragmentary side elevational view illustrating the sheet metal bending means in a second operating position.

The structure of the invention shown particularly in FIGS. 5 through 7 will operate to bend alternate hems, and it will also select the bending sequence, that is, the structure is controllable so that either the first and third hems introduced will be bent or the second and fourth hems.

Figure 8:
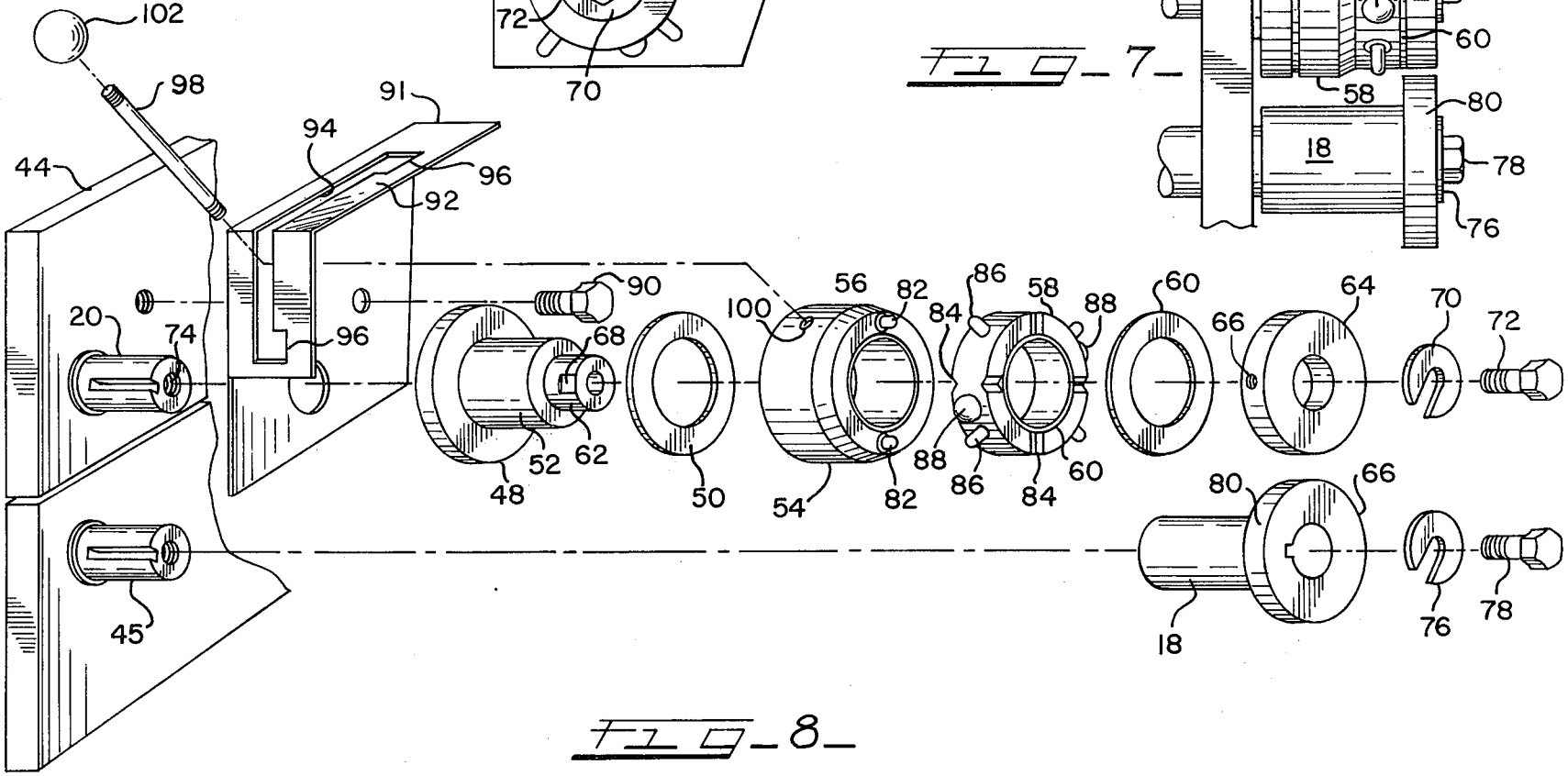
FIG. 8 is an exploded view of the structure shown in FIGS. 5 through 7.

The particular structure of this invention is located in the entry end of a roll forming machine, and this structure utilizes the first shaft 20 of the machine. Referring particularly to FIGS. 7 and 8, it will be noted that this shaft is journalled in an upright plate 44, and a lower shaft 45 supports the first lower roll 18 which is keyed thereto. It will be understood that with the exception of the particular roll design to be described, the machinery is characterized by conventional rolls already available for achieving the hem bending functions.

Furthermore, the particular construction of this invention can be readily adapted for use in association with various existing roll forming machines.

The particular structure of the invention comprises an upper forming roll assembly 46 which, as shown in FIG. 8 includes a first roll section 48 keyed to shaft 20 for movement therewith. A washer 50 is received around the cylinder portion 52 of this roll section, and a second roll section 54 provided with bushing 56 is also received on this cylinder section. Finally, the cylinder section supports a third roll section 58 and washer 60.

A smaller diameter section 62 is formed on the roll section 48, and driving roll member 64 is received on this section 62. A set screw is adapted to be received in threaded opening 66 for engagement with land 68 of the cylindrical section 62 for tying the roll section 64 thereto. A C-washer 70 is held in place by means of screw 72 which is in turn received in the threaded opening 74 of shaft 20. This holds the assembly 46 in position on the shaft.

The lower roll 18 is tied to the lower shaft 20 by means of C-washer 76 and screw 78. The driving section 80 of the lower roll 18 is then located in position directly opposite the drive roller 64 on the upper shaft.

The roller section 54 carries diametrically opposed spring loaded pins 82 which extend outwardly toward roller section 58. The latter defines notches 84 at 90° intervals whereby the pins 82 will serve as alignment means for controlling the relative positions of the sections 54 and 58 during the operating sequences to be described. In the embodiment illustrated, the section 58 is notched on both sides whereby this section can be placed on the shaft 20 with either side facing the pins 82.

The roller section 58 also carries radially extending pins 86, four such pins being illustrated at 90° intervals. These pins are preferably rigidly mounted but they may also be spring loaded in a conventional fashion so that, as with the pins 82, they can be pressed inwardly so that their outer ends are substantially flush with the surfaces from which they normally extend.

The roller section 58 also carries a pair of forming balls 88, these balls in the embodiment illustrated, being 180° apart. The forming balls are substantially rigidly positioned relative to the surfaces from which they extend so that these balls will serve as bending means and will not recede into the roller section when encountering resistance to bending.

The assembly illustrated in FIGS. 7 and 8 also includes a bracket 91 which is tied to the plate 44 by means of screw 90. The bracket defines a right angle flange 92 defining a slot 94 with notched ends 96. A somewhat flexible rod 90 has one threaded end received in the opening 100 defined by roll section 54. A handle 102 is attached to the other end of the rod. The notches 96 provide two operating positions of the handle, and it will be apparent that movement of the handle from one position to the other operates to shift the roll sections 54 and 58 relative to the shaft. The roll sections 54 and 58 are tied together by means of the pins 82 which are received in the notches 84.

As best shown in FIG. 7, the upper drive roller section 64 and lower drive portion 80 are spaced apart for purposes of receiving a sheet 24 to be formed. The roller section 54 is of larger diameter and thereby provides a surface against which the side edge of a sheet 24 can be engaged.

In a typical operation of a construction, the rod 98 is set in the position shown in FIG. 5 by pulling the rod into engagement with the lower notch 96. As indicated, this places a pin 86 into position for engagement by a sheet inserted into the machine. It will be appreciated that the roll section 54 is locked into position by the rod 98, and the roll section 58 carrying pins 86 is held in position due to the cooperating pins 82 and notches 84. Accordingly, rotation of the shafts 20 will not shift the roll section 58 away from the set position.

In the position of FIG. 5, the construction is adapted to form the first and third hems 42 along the top edge of the sheet 24 illustrated in FIG. 3. To accomplish this, the right-hand leading edge of the sheet is brought into engagement with the drive roller members 64 and 80. At this point, the sheet edge defining notch 30 is brought into engagement with a pin 86, and the driving force imparted to the sheet is sufficient to overcome the holding force of pins 82 in notches 54. Accordingly, the roller section 58 begins to rotate. This brings the ball 88 into engagement with the hem portion for bending of the hem portion.

Driving engagement of the edge of notch 30 with a pin 88 is terminated after 90° of movement of the roller portion 58, and at this point, the pins 82 engage a new set of ntches 84 whereby the roller 58 is held in a predetermined position. The pin 86 following the engaged pin is held against the hem surface and, when rigidly mounted, slightly depresses the metal. Alternatively, if the following pin is spring loaded, the pin is held in a depressed condition. In either case, since the driving force of the edge of notch 30 has been removed, the hem slides relative to the pin. When the first notch 28 is reached, the pin is received in the notch and the notch edge engages this pin. In the case of a rigid pin, the oncoming or trailing notch edge will be automatically in position for engaging the pin. Where the pin is spring-loaded, it snaps into the notch to provide that engagement.

This second driving engagement rotates the roller section 58 an additional 90° with the next pin coming into engagement with the sheet and being depressed thereby. This pin then snaps into position when the succeeding notch 28 is reached. A forming ball 88 is, therefore, brought into engagement with the hem portion 42 behind this succeeding notch. Accordingly, the roller section 58 is moved through 90° as each hem is encountered; however, since a forming ball 88 is encountered only once every 180°, a forming operation only occurs with respect to alternating hems.

In order to form the opposite side edge of the sheet 24, the left-hand end of the sheet as illustrated in FIG. 3 becomes the leading edge. Before insertion of the sheet, the rod 98 is shifted to the position shown in FIG. 6 and latched in place by means of the upper notch 96. As illustrated, when the end notch 36 encounters the first pin and rotates the roller section 58 through 90°, a forming ball does not engage a hem 40. When the second notch 34 is encountered, however, a forming ball will engage a hem 42 whereby the same alternating sequence as previously described is achieved. In view of the shifting of the mechanisms between the positions of FIGS. 5 and 6, the formation of the first and third hems or of the second and fourth hems can be readily controlled.

As previously noted, the assembly 46 basically achieves a small bend in the hems 42, and this bend is sufficient to achieve additional forming of these hems by the succeeding forming rolls 18. These forming rolls are all of conventional design, and in the absence of the small bend achieved by the assembly 46, the hems 40 will not be acted upon by the succeeding forming rolls. These hems will thus be unformed to achieve the duct structure of FIG. 4.

It will be apparent that there has been described a structural arrangement which involves straightforward shifting of a mechanism to selectively provide alternating hem bending on a metal sheet used for producing ducts. It will also be apparent that the concepts of the invention are readily adaptable for variations which will achieve essentially the same functions on sheets of comparable character. In particular, the number of forming balls, indexing pins, etc., could be varied to achieve different bending sequences.

It will be understood that various other changes and modifications may be made in the above described construction which provide the characteristics of the invention particularly as defined in the following claims.

That which is claimed is:

1.In an apparatus for bending a metal sheet wherein a plurality of forming rolls progressively bend a sheet portion, the improvement in a first bending station of the apparatus comprising a first roll, means for mounting said first roll for rotation about its axis, forming protrusions positioned in spaced apart relationship on the surface of said first roll, roll drive elements engageable by said sheet and carried by said first roll, movement of said sheet against a drive element operating to move a forming protrusion into contact with the sheet for bending the sheet, and including means for angularly shifting the position of said first roll relative to said mounting means to thereby determine the drive element engaged by the sheet and to thereby determine the protrusion contacting the sheet.

2. An apparatus in accordance with claim 1 wherein said sheet defines spaced apart hems, the leading edges of said hems comprising the sheet portions moving into engagement with said drive elements.

3. An apparatus in accordance with claim 1 wherein said forming protrusions comprise hardened balls with portions thereof extending outwardly relative to said first roll surface.

4. An apparatus in accordance with claim 3 wherein said drive elements comprise pins extending outwardly from said first roll surface.

5. An apparatus in accordance with claim 1 wherein said first roll is mounted in assembly with a positioning roll, said mounting means including indexing means associated with said assembly for relatively positioning said first roll in successive predetermined positions relative to said positioning roll during a forming operation.

6. An apparatus in accordance with claim 5 including a handle associated with said assembly for shifting the assembly to position said first roll, and including means for latching said positioning roll in a stationary position in the apparatus after the assembly has been shifted to an operating position.

7. An apparatus in accordance with claim 5 wherein said indexing means comprise spring loaded pins defined by one roll and said assembly, and depressions defined by the other roll in the assembly for receiving said pins.

8. An apparatus in accordance with claim 7 wherein said pins and associated depressions in the assembly are provided on abutting faces of said rolls in the assembly.

9. An apparatus in accordance with claim 4 wherein a pair of said balls are mounted in diametrically opposite locations on said first roll surface and including four drive element pins mounted at 90° intervals on said surface.

10. An apparatus in accordance with claim 9 wherein the sheet to be formed defines four spaced apart hems divided by notches, said drive element pins being adapted to be received in said notches whereby sheet edges defining the notches will engage the drive element pins.

11. An apparatus in accordance with claim 4 wherein said pins are rigidly held relative to said first roll surface, the pins operating to depress a surface portion of said sheet when in engagement therewith.

12. An apparatus in accordance with claim 4 wherein said pins are spring loaded, said pins being adapted to be pressed inwardly of said first roll when in engagement with a surface portion of said sheet.

* * * * *